US006279678B1

(12) United States Patent
Tracy

(10) Patent No.: US 6,279,678 B1
(45) Date of Patent: Aug. 28, 2001

(54) SPEAKER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 0 days.

(21) Appl. No.: 09/650,188

(22) Filed: Aug. 29, 2000

(51) Int. Cl.[7] ..... H05K 5/00
(52) U.S. Cl. ..... 181/144; D17/199
(58) Field of Search ..... 181/199, 144, 181/166; 381/335; D14/204, 206, 205

(56) References Cited

U.S. PATENT DOCUMENTS

| | | | | |
|---|---|---|---|---|
| 4,923,031 | * | 5/1990 | Carlson | 181/144 |
| 5,222,145 | * | 6/1993 | Draffen | 381/24 |
| 5,258,584 | * | 11/1993 | Hubbard | 181/147 |
| 5,321,756 | * | 6/1994 | Patterson | 381/24 |
| 5,514,841 | * | 5/1996 | Rocha | 181/156 |
| 5,874,695 | * | 8/2000 | Tracy | 181/147 |
| 6,098,743 | * | 8/2000 | McGrath | 181/150 |
| 6,118,883 | * | 9/2000 | Rocha | 181/387 |

* cited by examiner

*Primary Examiner*—Bentsu Ro
*Assistant Examiner*—Kim Lockett
(74) *Attorney, Agent, or Firm*—Welsh & Flaxman LLC

(57) ABSTRACT

The speaker assembly includes a speaker housing having a closed top wall and an opposed open end. The speaker assembly further includes a first sound source having a cone with an interior surface and an exterior surface. The first sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the first sound source. The speaker assembly also includes a second sound source having a cone with an interior surface and an exterior surface. The second sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the second sound source. The exposed portion of the first sound source faces a direction opposite the exposed portion of the second sound source to create stereo separation between the first and second sound sources.

20 Claims, 4 Drawing Sheets

SPEAKER ASSEMBLY

BACKGROUND OF THE INVENTION

1. Field of the Invention

The invention relates to a speaker assembly. More particularly, the invention relates to a speaker assembly with reduced size and weight to enhance the performance of the speaker assembly within aircraft.

2. Description of the Prior Art

The current global community has made it possible for people from around the country, and around the world, to interact for both business and personal reasons. For many people, this requires that they spend considerable time traveling from one location to another location. More often than not, these people travel in aircraft.

Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft makes it very difficult to incorporate high fidelity systems within an aircraft. This problem is especially pronounced for audio speaker assemblies when one attempts to meet the size, weight and shape requirements for use in aircraft.

In the aircraft industry great priority is placed upon component weight and size reduction. Range and payload are adversely affected by conventional terrestrial designs. These concerns are notable when one attempts to make changes within smaller private jets. For example, a small increase in the weight carried by an aircraft results in a substantial increase in the fuel consumption of the aircraft. In addition, the limited space available within an aircraft dictates that the use of any space within the aircraft be carefully considered by those responsible for ensuring the comfort of passengers.

Lightweight and compact audio speakers are currently available. These speakers, however, substantially compromise sound quality for reductions in size and weight. An individual wishing to add an audio system to an aircraft must make a choice between high fidelity speakers which do not suit the size and weight requirements of the aircraft and lower quality speakers providing desirable size and weight characteristics.

A need, therefore, exists for a speaker assembly providing a high fidelity sound, while also meeting the size and weight requirements of an aircraft. The present invention provides such a speaker assembly.

SUMMARY OF THE INVENTION

It is, therefore, an object of the present invention to provide a speaker assembly including a speaker housing having a closed top wall and an opposed open end. The speaker assembly further includes a first sound source having a cone with an interior surface and an exterior surface. The first sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the first sound source. The speaker assembly also includes a second sound source having a cone with an interior surface and an exterior surface. The second sound source is mounted within the speaker housing such that the interior surface of the cone faces the closed top wall and the exterior surface substantially faces the opposed open end. A portion of the exterior surface of the cone is covered, thereby, revealing an exposed portion which defines the directionality of the second sound source. The exposed portion of the first sound source faces a direction opposite the exposed portion of the second sound source to create stereo separation between the first and second sound sources.

It is also an object of the present invention to provide a speaker wherein foam covers the exterior surface of the first sound source and foam covers the exterior surface of the second sound source.

It is another object of the present invention to provide a speaker wherein the exposed portion of the first sound source amounts to a segment of approximately 25% to approximately 40% of the exterior surface of the first sound source and the exposed portion of the second sound source amounts to a segment of approximately 25% to approximately 40% of the exterior surface of the second sound source.

It is a further object of the present invention to provide a speaker wherein the first and second sound sources are midrange drivers.

It is also an object of the present invention to provide a speaker including a first tweeter positioned adjacent the first sound source and a second tweeter positioned adjacent the second sound source. The first tweeter and the second tweeter are outwardly mounted in opposition to generate a stereo image.

It is still another object of the present invention to provide a speaker wherein the first tweeter is mounted between approximately a 25° angle and approximately a 75° angle relative to the opposed open end of the speaker housing and the second tweeter is mounted between approximately a 25° angle and approximately a 75° angle relative to the opposed open end of the speaker housing.

It is yet a further object of the present invention to provide a speaker including a public address driver.

It is also an object of the present invention to provide a speaker wherein the cone of the first sound source directly engages the closed top wall to define an enclosed spaced bounded by the closed top wall and the interior surface of the cone and the cone of the second sound source directly engages the closed top wall to define an enclosed spaced bounded by the closed top wall and the interior surface of the cone.

It is still another object of the present invention to provide a speaker wherein a first clamp secures the first sound source to the closed top wall and a second clamp secures the second sound source to the closed top wall.

It is also an object of the present invention to provide a speaker assembly wherein the first sound source is mounted within the speaker housing such that the interior surface of the cone faces the closed top wall and the exterior surface substantially faces the opposed open end. A gasket is positioned between the edge of the cone and the closed top wall of the speaker housing. The gasket traps air between the interior surface of the cone and the closed top wall to enhance the performance of the sound source, such that the enclosed space defined by the interior surface of the cone and the closed top wall is substantially free of the gasket and the closed top wall, the depth of the gasket, and interior surface of the cone define the enclosed space.

It is another object of the present invention to provide a speaker wherein the gasket includes an interior edge which substantially follows the edge of the cone.

It is still a further object of the present invention to provide a speaker wherein the gasket is foam secured to the top closed wall upon which the edge of the cone is mounted.

It is also an object of the present invention to provide a speaker wherein the foam includes an interior edge which substantially follows the edge of the cone, and the closed top wall, the depth of the foam, and interior surface of the cone define the enclosed space.

It is another object of the present invention to provide a speaker wherein the foam covers all of the closed top wall with the exception of the enclosed space.

It is also an object of the present invention to provide a speaker assembly including a first sound source covered to alter the resonant characteristics of the first sound source, a second sound source covered to alter the resonant characteristics of the first sound source, a first tweeter positioned adjacent the first sound source and a second tweeter positioned adjacent the second sound source. The first tweeter and the second tweeter are outwardly mounted in opposition to generate a stereo image. The frequency response altered by covering the first sound source and the second sound source create a physical crossover network.

It is another object of the present invention to provide a speaker wherein a portion of the first sound source is covered thereby revealing an exposed portion which defines the directionality of the first sound source and a portion of the second sound source is covered thereby revealing an exposed portion which defines the directionality of the first sound source.

It is a further object of the present invention to provide a speaker wherein foam covers the first sound source and foam covers the second source.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
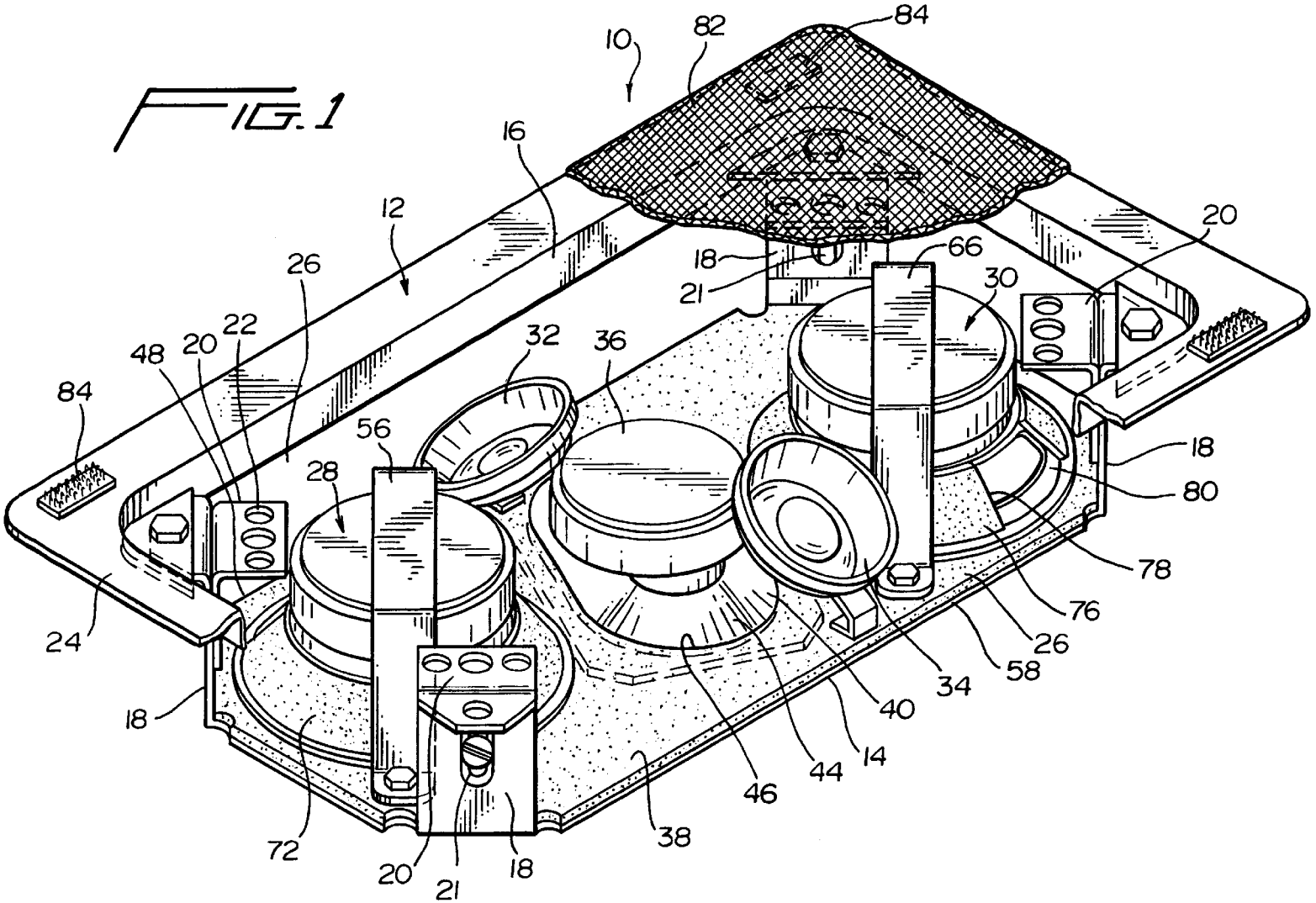
FIG. 1 is a cut away perspective view of the present speaker assembly.
Figure 2:
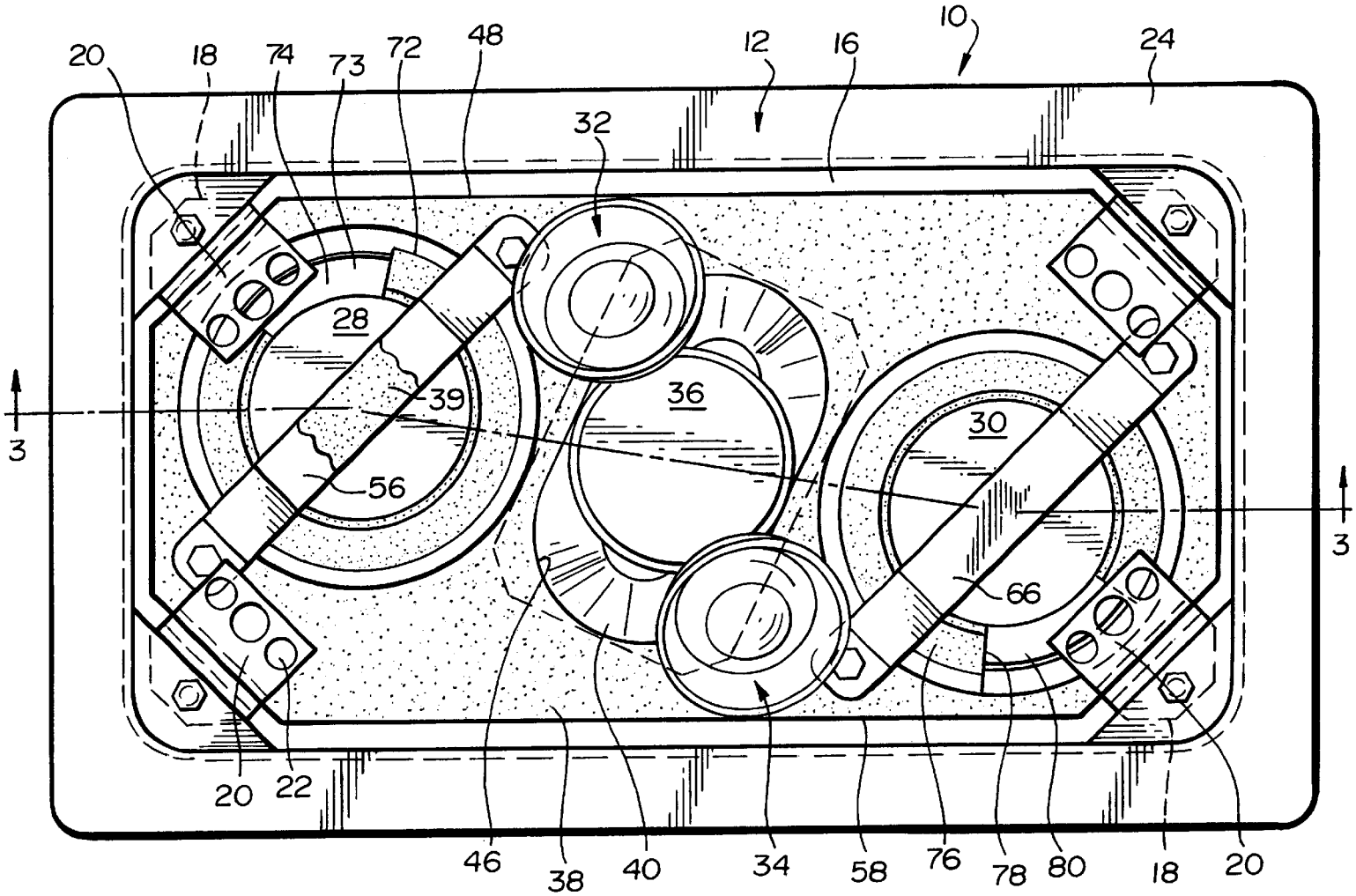
FIG. 2 is a top view of the present speaker assembly.
Figure 3:
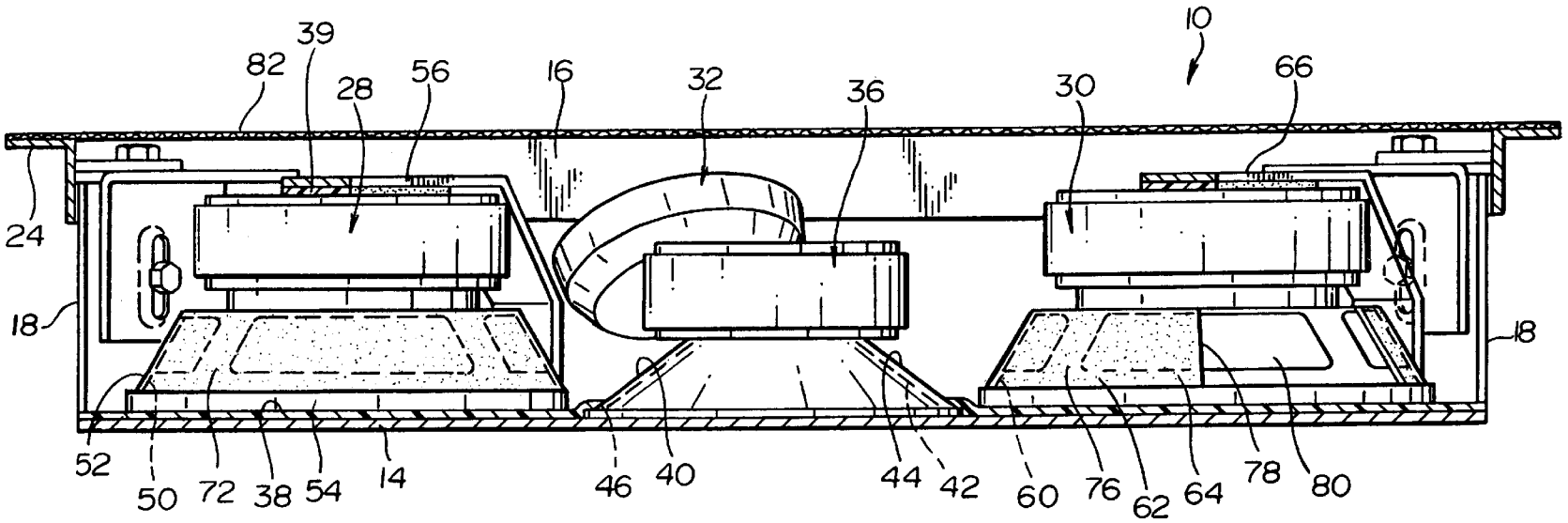
FIG. 3 is a cross sectional view along the line 3—3 in FIG. 2.

With reference to FIGS. 1–3, a low profile speaker assembly 10 is disclosed. The speaker assembly 10 incorporates a variety of features which reduce the size and weight of the speaker assembly 10, without compromising the integrity of the sound generated by the speaker assembly 10. The speaker assembly 10 is primarily intended for use in aircraft, where weight and size are critical. The speaker assembly 10 is designed to extend longitudinally within the center of the cabin. While the speaker assembly 10 is preferably designed for use in aircraft, the speaker assembly may be used in a variety of environments, such as wall enclosed room speakers, automotive speakers or within personal computers, without departing from the spirit of the present invention.

The speaker assembly 10 includes a speaker housing 12 with a closed top wall 14 and an opposed open end 16. The closed top wall 14 forms a support surface upon which the active speaker components are mounted. The speaker housing 12 is preferably constructed from aluminum, although other materials may be employed without departing from the spirit of the present invention.

In accordance with the preferred embodiment of the present invention, the closed top wall 14 is substantially rectangular, although other shapes may be employed without departing from the spirit of the present invention. Four corner mounts 18 extend upwardly from the respective corners of the closed top wall 14. Each corner mount 18 includes an inwardly directed bracket 20 with apertures 22 adapted for attaching the speaker assembly 10 within the fuselage of an aircraft. The brackets 20 are respectively mounted to a slot 21 formed in each corner mount 18 via screwing such that the position of each bracket may be adjusted to facilitate proper installation.

The corner mounts 18 attach to a mounting bracket 24 of the aircraft. The mounting bracket 24 is adapted to facilitate the installation of the present speaker assembly 10 within an aircraft fuselage.

For reasons that will be better appreciate based upon the following disclosure, the sides 26 of the speaker assembly 10 adjacent the active components remain open. The open spaces reduce the weight of the speaker assembly 10, while also reducing sound cancellation to improve the sound quality of the present speaker assembly 10.

The active components of the speaker assembly 10 include first and second midrange drivers 28, 30, first and second high frequency drivers (i.e., tweeters) 32, 34 and a public address driver 36. The active components are mounted within the speaker housing 12 such that the first midrange driver 28 and the first tweeter 32 are mirror images of the second midrange driver 30 and the second tweeter 34. As will be discussed in greater detail below, and with the exception of the public address driver 36, the components are wired to produce stereo sound; that is, the first midrange 28 and tweeter 32 are wired to receive a left channel signal, while the second midrange 30 and tweeter 34 are wired to receive a right channel signal (not shown). The public address driver 36 is distinct from the other active components, and is designed for the transmission of announcement messages commonly issued from the flight crew. While the preferred embodiment is disclosed as providing stereo sound, it is contemplated that the arrangement of components could be varied without departing from the spirit of the present invention.

A sheet of foam insulation 38 (FAA approved for burn test) is secured to the closed top wall 14 of the speaker housing 12 between the active components and the closed top wall 14 of the speaker housing 12. The public address driver 36 is a conventional midrange driver with a cone 40 and is mounted substantially at the center of the speaker housing 12. The cone 40 includes an interior surface 42 which is directed toward the closed top wall 14. In this way, sound emitted from the exterior surface 44 of the public address driver 36 is directed through the opposed open end 16.

The sound generated by the public address driver 36 is enhanced by removing foam insulation 38 from within the space defined by the meeting point of the edge 46 of the public address driver cone 40 and the closed top wall 14. In fact, the foam 38 is cut away such that the foam insulation 38 forms a gasket about the edge 46 of the public address driver cone 40, sealing the space defined between the interior surface 42 of the cone 40 and the top closed wall 14.

The gasket traps air between the interior surface 42 of the cone 40 and the closed top wall 14 to enhance the performance of the public address driver 36, such that the enclosed space defined by the interior surface 42 of the cone 40 and the closed top wall 14 is substantially free of the foam insulation 38. In practice, the depth of the foam insulation 38, the closed top wall 14 and the interior surface 42 of the cone 40 define the enclosed space.

The first midrange driver 28 and first tweeter 32 are mounted along a first side 48 of the closed top wall 14. The first midrange driver 28 is connected to the closed top wall 14 of the speaker housing 12 such that the interior surface 50 of the cone 52 of first midrange driver 28 faces the closed top wall 14 of the speaker housing 12. The exterior edge 54 of the cone 52 is directly attached to the closed top wall 14 to seal off the space defined by the interior surface 50 of the cone 52 of the first midrange driver 28. The cone 52 is held in contact with the closed top wall 14 by a first clamp 56 wrapped about the first midrange driver 28 and then bolted to the closed top wall 14. A piece of foam insulation 39 is preferably positioned between the first clamp 56 and the first midrange driver 28 to prevent rattling which may occur between the first clamp 56 and the first midrange driver 28. While a clamp is used to mount the first midrange driver 28 to the closed top wall 14, those skilled in the art will appreciate the fact that other attachment techniques may be employed without departing from the spirit of the present invention.

As will be discussed in greater detail below, the first tweeter 32 is mounted adjacent the first midrange driver 28. The first tweeter 32 is mounted such that it faces away from the closed top wall 14. The first tweeter 32 is also positioned in an opposed relationship with the second tweeter 34 to enhance the stereo separation produced by the present speaker assembly 10.

As with the first midrange driver 28 and tweeter 32, the second midrange driver 30 and second tweeter 34 are mounted along a second side 58 of the closed top wall 14. The second midrange driver 30 is connected to the closed top wall 14 of the speaker housing 12 such that the interior surface 60 of the cone 62 of second midrange driver 30 faces the closed top wall 14. The exterior edge 64 of the cone 62 is directly attached to the closed top wall 14 to seal off the space defined by the interior surface 60 of the cone 62 of the second midrange driver 30. The second midrange driver 30 is coupled thereto by a second clamp 66 in the same manner as discussed above with regard to the first midrange driver 28.

The second tweeter 34 is mounted adjacent the second midrange driver 30. As was discussed above, the second tweeter 34 is mounted to face away from the closed top wall 14 and the first tweeter 32. In fact, the second tweeter 34 is positioned in an opposed relationship with the first tweeter 32 to enhance the stereo separation produced by the present speaker assembly 10.

The first tweeter 32 and the second tweeter 34 are respectively mounted on opposites sides of the speaker housing 12, producing a true stereo image with minimal "footprint" (that is, a true stereo image is produced with the use of minimal space). The minimal space needed is facilitated by inverting the first and second midrange drivers 28, 30. Inversion of the first and second midrange drivers 28, 30 creates the extra space adjacent the open end 16 of the speaker housing 12 needed for mounting the first and second tweeters 32, 34 in an opposed relationship.

As stated above, the first tweeter 32 receives a left channel of a stereo signal and the second tweeter 34 receives a right channel of a stereo signal. Although the first and second tweeters 32, 34 are closely mounted within a single speaker housing 12, a stereo image is produced by outwardly mounting the tweeters in opposition. Specifically, the tweeters are mounted between approximately a 25° angle and a 75° angle relative to the plane of the opposed open end 16, and preferably at approximately a 45° angle relative to the plane of the opposed open end 16. In addition, the lateral orientation of the tweeters may be varied, although the preferred embodiment employs a lateral orientation of 45° relative to a plane extending from the first long side 68 of the speaker housing 12 to the second long side 70 of the speaker housing 12.

The stereo separation produced by the present speaker assembly 10 is further enhanced by the provision of foam wrap 72 provided about a substantial portion of the cone exterior of the midranges. Specifically, foam wrap 72 is secured about a substantial portion of the first midrange driver 28 with a preselected portion 73 of the cone exterior 74 remaining exposed. The exposed portion 73 amounts to a segment of between approximately 25% and 40% of the entire cone circumference. The exact extent of the exposed portion 73 is determined based upon the resonant frequency, as well as other characteristics, of the midrange driver employed, such that the performance of the present speaker assembly 10 is optimized. In accordance with the preferred embodiment of the present invention, the exposed portion 73 faces substantially away from the exposed portion 78 of second midrange driver 30 (see below) to enhance the stereo separation produced by the present speaker assembly 10.

Foam wrap 76 is similarly secured about a substantial portion of the second midrange driver 30 with a preselected portion 78 of the cone exterior 80 remaining exposed. As with the first midrange driver 28, the exposed portion 78 amounts to a segment of between approximately 25% to 40% of the entire cone circumference. In accordance with the preferred embodiment of the present invention, the exposed portion 78 faces substantially away from the exposed portion 73 of first midrange driver 28. In fact, the exposed portions 73, 78 are respectively aligned with the first and second tweeters 32, 34 to enhance the stereo separation produced by the present speaker assembly 10.

In accordance with the preferred embodiment of the present invention, the foam wrap is ⅛" black Safelite™ foam applied to the cone exterior surface 74, 80 with adhesive. While foam wrap is used to improve the directional characteristics of the midrange drivers employed in accordance with the present invention, other techniques may be used without departing from the spirit of the present invention. For example, it is contemplated that the clamps discussed above may be formed to completely cover the drivers with the exception of a port formed in the clamp. The port would permit the control of emitted sound in much the same manner the foam wrap controls the emitted sound. Similarly, a combination of metal and foam may be used to controlled the sound emitted by the exterior surface of the first and second midrange drivers.

In use, sound from the first midrange driver 28 is primarily radiated from the exposed portion 73 and directed away from the exposed portion 78 of the second midrange driver 30. Similarly, the first tweeter 32 directs sound in a predetermined direction away from the second tweeter 34.

The directionality produced by the first and second midrange drivers 28, 30 and the first and second tweeters 32, 34 generates distinct and desirable stereo separation from a single compact speaker assembly 10. In addition, the design of the inverted first and second midrange drivers 28, 30 enhances the sound quality of the speaker assembly 10, while also reducing the size and weight of the speaker assembly 10. Specifically, the foam wraps 72, 76 improve the directionality of the midrange drivers 28, 30. The sound ultimately heard from the midrange drivers 28, 30 by an individual is substantially the sound radiating from the cone exteriors 74, 80 of the midrange drivers 28, 30.

The inclusion of the foam wrap 72, 76 about the cone exteriors 74, 80 of the midrange drivers 28, 30 also functions to improve the frequency response of the sound emitted from the exterior surfaces of the cones. Specifically, the foam wrap 72, 76 limits the passage of specific frequencies, while permitting other frequencies from passing therethrough. The foam wrap 72, 76 also improves phase cancellation and resonant characteristics associated with the midrange drivers 28, 30. In this way, the foam wrap 72, 76 functions as a physical crossover and obviates the need for the use of a traditional crossover network. The removal of a traditional electronic crossover network from the present speaker assembly results in a dramatic weight and size reduction. Specifically, speaker assemblies in accordance with the present invention have been manufactured with a weight as little as 1 lb. 1 oz. In addition to reducing the weight of the present speaker assembly, the physical crossover network simplifies the design and manufacture, while also reducing cost.

In addition to creating a speaker assembly 10 with improved directionality, the inverted positioning of the first and second midrange drivers 28, 30 allows more proximate positioning of the tweeters 32, 34 in both the vertical and horizontal planes. The ability to position the tweeters 32, 34 more proximate reduces the size and weight of the entire speaker assembly 10. The proximate positioning of the tweeters 32, 34 and midrange drivers 28, 30 provides additional space within the speaker housing 12 to enable an installer to access the speaker housing 12 and bolt the speaker assembly to the headliner of the aircraft.

Installation of the speaker assembly is completed by mounting the speaker assembly 10 at a desired location such that the opposed open end 16 of the speaker assembly 10 is directed toward the listening environment and the closed top wall 14 of the speaker housing 12 is directed away from the listening environment. Once the speaker assembly 10 is properly mounted, an expanded metal/perforated speaker grill 82 is placed over the opposed open end 16 of the speaker assembly 10 to hide the contents of the speaker assembly 10 and protect the acoustic components found within the speaker housing 12. The speaker grill 82 is secured to the mounting bracket 24 by a hook and loop fastening 84, although the speaker grill 82 may be secured to the speaker housing 12 in a variety of manners without departing from the spirit of the present invention. In addition, the speaker grill 82 may be secured on the speaker housing 12 prior to installing the speaker assembly 10 at a desired location. The speaker grill 82 should be designed such that it limits interference with sound generated by the tweeters 32, 34 to ensure a high quality stereo sound field.

The embodiment disclosed in FIGS. 1, 2 and 3 is designed for placement in the space within an aircraft designed for an oxygen box, and is 4.2" wide, 8.25" long, and 1.5" deep. The speaker assembly 10 also weighs only 1 lb. 9 oz. and has a radius of curvature of shaped to conform with the space in which it must fit.

Figure 4:
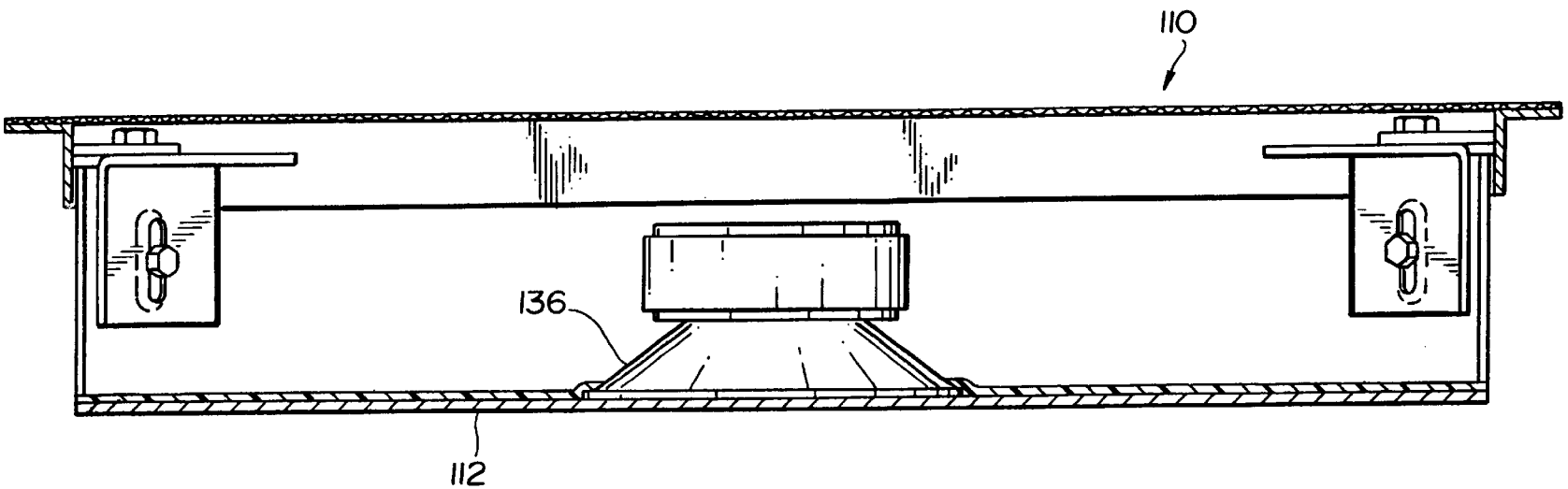
FIG. 4 is a cross sectional view of an alternate embodiment in accordance with the present invention.

While the speaker assembly 10 disclosed in FIGS. 1 to 3, employs pairs of tweeters and midrange drivers to produce a stereo image, speaker assemblies 110 including only the public address driver 136 are considered to fall within the spirit of the present invention. Specifically, and with reference to FIG. 4, a speaker assembly 110 with only the disclosed public address driver 136 is mounted within a speaker housing 112 substantially as discussed above. The speaker assembly 110 may then be installed. If, at a later date, the owner of the aircraft wishes to retrofit the aircraft with stereo sound, the public address driver only speakers may simply be replaced with the stereo speaker assemblies discussed above.

By employing simple public address speaker assemblies 110 in accordance with the present invention, substantial weight savings are achieved. Specifically, by employing the open speaker housing 112 of the present invention and removing a small portion of foam, a substantial weight savings (approximately 2 lbs.) is achieved when one considers the many public address speakers which would be employed in a conventional aircraft.

While the preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A speaker assembly, comprising:

a speaker housing having a closed top wall and an opposed open end;

a first sound source including a cone having an interior surface and an exterior surface, the first sound source being mounted within the speaker housing such that the interior surface of the cone faces the closed top wall and the exterior surface substantially faces the opposed open end, wherein a portion of the exterior surface of the cone is covered thereby revealing an exposed portion which defines the directionality of the first sound source;

a second sound source including a cone having an interior surface and an exterior surface, the second sound source being mounted within the speaker housing such that the interior surface of the cone faces the closed top wall and the exterior surface substantially faces the opposed open end, wherein a portion of the exterior surface of the cone is covered thereby revealing an exposed portion which defines the directionality of the second sound source;

wherein the exposed portion of the first sound source faces a direction opposite the exposed portion of the second sound source to create stereo separation between the first and second sound sources.

2. The speaker assembly according to claim 1, wherein foam covers the exterior surface of the first sound source and foam covers the exterior surface of the second sound source.

3. The speaker assembly according to claim 2, wherein the exposed portion of the first sound source amounts to a segment of approximately 25% to approximately 40% of the exterior surface of the first sound source and the exposed portion of the second sound source amounts to a segment of approximately 25% to approximately 40% of the exterior surface of the second sound source.

4. The speaker assembly according to claim 1, wherein the first sound source is a midrange driver and the second sound source is a midrange driver.

5. The speaker assembly according to claim 4, further including a first tweeter positioned adjacent the first sound source and a second tweeter positioned adjacent the second sound source, the first tweeter and the second tweeter are outwardly mounted in opposition to generate a stereo image.

6. The speaker assembly according to claim 5, wherein the first tweeter is mounted between approximately a 25° angle and approximately a 75° angle relative to the opposed open end of the speaker housing and the second tweeter is mounted between approximately a 25° angle and approximately a 75° angle relative to the opposed open end of the speaker housing.

7. The speaker assembly according to claim 1, further including a public address driver.

8. The speaker assembly according to claim 1, wherein the cone of the first sound source directly engages the closed top wall to define an enclosed spaced bounded by the closed top wall and the interior surface of the cone and the cone of the second sound source directly engages the closed top wall to define an enclosed spaced bounded by the closed top wall and the interior surface of the cone.

9. The speaker assembly according to claim 8, wherein a first clamp secures the first sound source to the closed top wall and a second clamp secures the second sound source to the closed top wall.

10. A speaker assembly, comprising:

a speaker housing having a closed top wall and an opposed open end;

a sound source including a cone having an interior surface and an exterior surface, the first sound source being mounted within the speaker housing such that the interior surface of the cone faces the closed top wall and the exterior surface substantially faces the opposed open end;

a gasket positioned between the edge of the cone and the closed top wall of the speaker housing, the gasket trapping air between the interior surface of the cone and the closed top wall to enhance the performance of the sound source, such that the enclosed space defined by the interior surface of the cone and the closed top wall is substantially free of the gasket and the closed top wall, the depth of the gasket, and interior surface of the cone define the enclosed space.

11. The speaker assembly according to claim 10, wherein the gasket includes an interior edge which substantially follows the edge of the cone.

12. The speaker assembly according to claim 10, wherein the gasket is foam secured to the top closed wall upon which the edge of the cone is mounted.

13. The speaker assembly according to claim 12, wherein the foam includes an interior edge which substantially follows the edge of the cone, and the closed top wall, the depth of the foam, and interior surface of the cone define the enclosed space.

14. The speaker assembly according to claim 12, wherein the foam covers all of the closed top wall with the exception of the enclosed space.

15. A speaker assembly, comprising:

a speaker housing having a closed top wall and an opposed open end;

a first sound source covered to alter the resonant characteristics of the first sound source;

a second sound source covered to alter the resonant characteristics of the first sound source;

a first tweeter positioned adjacent the first sound source and a second tweeter positioned adjacent the second sound source, the first tweeter and the second tweeter are outwardly mounted in opposition to generate a stereo image;

wherein the frequency response altered by covering the first sound source and the second sound source creates a physical crossover network.

16. The speaker assembly according to claim 15, wherein a portion of the first sound source is covered thereby revealing an exposed portion which defines the directionality of the first sound source and a portion of the second sound source is covered thereby revealing an exposed portion which defines the directionality of the first sound source.

17. The speaker assembly according to claim 16, wherein foam covers the first sound source and foam covers the second source.

18. The speaker assembly according to claim 15, wherein the first sound source includes a cone having an interior surface and an exterior surface, the first sound source being mounted within the speaker housing such that the interior surface of the cone faces the closed top wall and the exterior surface substantially faces the opposed open end, wherein the exterior surface of the cone is covered; and second sound source includes a cone having an interior surface and an exterior surface, the second sound source being mounted within the speaker housing such that the interior surface of the cone faces the closed top wall and the exterior surface substantially faces the opposed open end, wherein the exterior surface of the cone is covered.

19. The speaker assembly according to claim 18, wherein a portion of the exterior surface of the cone is covered thereby revealing an exposed portion which defines the directionality of the first sound source and a portion of the exterior surface of the cone is covered thereby revealing an exposed portion which defines the directionality of the second sound source.

20. The speaker assembly according to claim 19, wherein foam covers the first sound source and foam covers the second source.

* * * * *